US010806262B1

(12) United States Patent
Liu

(10) Patent No.: US 10,806,262 B1
(45) Date of Patent: Oct. 20, 2020

(54) FOLDING CHAIR

(71) Applicant: TAIWAN SHIN YEH ENTERPRISE CO., LTD., Chiayi Hsien (TW)

(72) Inventor: Hung-Tsun Liu, Chiayi (TW)

(73) Assignee: TAIWAN SHIN YEH ENTERPRISE CO., LTD., Chiayi Hsien (TW)

( * ) Notice: Subject to any disclaimer, the term of this patent is extended or adjusted under 35 U.S.C. 154(b) by 0 days.

(21) Appl. No.: 16/385,409

(22) Filed: Apr. 16, 2019

(51) Int. Cl.
*A47C 4/10* (2006.01)
*A47C 4/20* (2006.01)

(52) U.S. Cl.
CPC . *A47C 4/20* (2013.01); *A47C 4/10* (2013.01)

(58) Field of Classification Search
CPC .... A47C 4/10; A47C 4/14; A47C 4/20; A47C 4/24
See application file for complete search history.

(56) References Cited

U.S. PATENT DOCUMENTS 1,976,567 A * 10/1934 Kovats ..... A47C 4/10 297/47
2,044,473 A * 6/1936 Geller ..... A47C 4/10 297/59
2,221,932 A * 11/1940 Utley ..... A47C 4/10 248/439
2,244,399 A * 6/1941 Kovats ..... A47C 4/10 297/47
2,613,729 A * 10/1952 Anderson ..... A47C 4/10 297/42
2,697,481 A * 12/1954 Zoercher ..... A47C 4/10 297/60
3,236,558 A * 2/1966 Kaufman ..... A47C 4/10 297/59
7,021,705 B1 * 4/2006 Niermeyer ..... A47C 4/04 297/55
D617,108 S * 6/2010 Niermeyer ..... D6/368
10,485,349 B1 * 11/2019 Grandberg ..... A47C 4/10
2008/0197676 A1 * 8/2008 Wright ..... A47C 4/10 297/47
2012/0313402 A1 * 12/2012 Aldred ..... A47C 4/10 297/16.1
2014/0354018 A1 * 12/2014 Moore ..... A47B 85/04 297/120

FOREIGN PATENT DOCUMENTS

CH 255360 A * 6/1948 ..... A47C 4/10
DE 29520569 U1 * 3/1996 ..... A47C 4/10
GB 880087 A * 10/1961 ..... A47C 4/10

* cited by examiner

*Primary Examiner* — Timothy J Brindley
(74) *Attorney, Agent, or Firm* — Muncy, Geissler, Olds & Lowe, P.C.

(57) ABSTRACT

A folding chair includes a seat, a front leg unit, a rear leg unit, at least one coupling rod unit, and a safety mechanism. The folding chair is convertible between a folded state and an unfolded state. When the folding chair is in the unfolded state, a blocking member of the safety mechanism is switchable between a locked state, in which the blocking member abuts against a first coupling rod for blocking movement of the at least one coupling rod unit to maintain the folding chair in the unfolded state, and an unlocked state, in which the first coupling rod is not obstructed by the blocking member, such that conversion of the folding chair to the folded state to the folded state is permitted.

6 Claims, 8 Drawing Sheets

FOLDING CHAIR

FIELD

The disclosure relates to a chair, and more particularly to a foldable chair.

BACKGROUND

A conventional folding chair includes a seat, two front legs, two rear legs, and a chair back. When the folding chair is folded, the components the folding chair are essentially aligned to be proximate to and parallel to each other, such that the folding chair takes less space and becomes portable for many occasions. Despite its convenient traits, the folding chair may still pose safety concern for small children, as they may get clamped by the folding movement of the folding chair while handling the folding chair as a part of the play.

SUMMARY

Therefore, an object of the disclosure is to provide a folding chair that can alleviate the drawback of the prior art.

According to the disclosure, the folding chair includes a seat, a front leg unit pivotally connected to a front end portion of the seat, a rear leg unit pivotally connected to a rear end portion of the seat, a chair back connected to a top end of the rear leg unit, at least one coupling rod unit, and a safety mechanism. The at least one coupling rod unit includes a first coupling rod that has opposite ends pivotally and respectively connected to the seat and the rear leg unit, a second coupling rod that has opposite ends pivotally and respectively connected to the front leg unit and the first coupling rod, and a third coupling rod that has opposite ends pivotally and respectively connected to the second coupling rod and the rear leg unit. The safety mechanism includes a blocking member that is disposed in proximity to the first coupling rod of the at least one coupling rod unit.

The folding chair is convertible between a folded state and an unfolded state. The first coupling rod is disposed under the seat when the folding chair is in the unfolded state, and is downwardly pivotable relative to the seat to convert the folding chair from the unfolded state to the folded state via pivotal movements of the second and third coupling rods.

When the folding chair is in the unfolded state, the blocking member is switchable between a locked state, in which the blocking member abuts against a bottom of the first coupling rod for blocking movement of the first coupling rod to maintain the folding chair in the unfolded state, and an unlocked state, in which the bottom of the first coupling rod is not obstructed by the blocking member, such that conversion of the folding chair to the folded stated is permitted.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
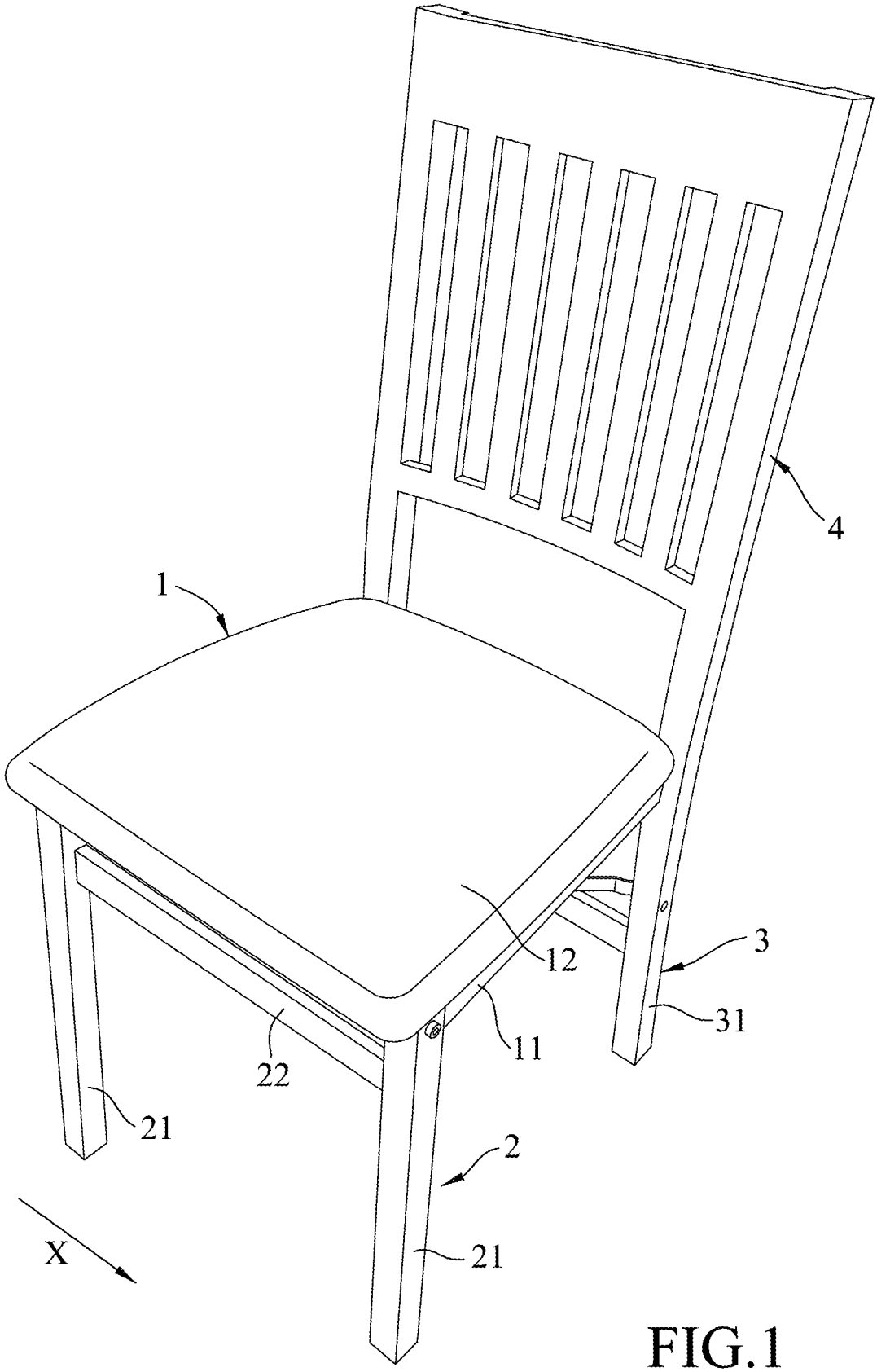
FIG. 1 is a perspective view of an embodiment of a folding chair according to the disclosure.

Referring to FIGS. 1 to 5, an embodiment of a folding chair according to the disclosure includes a seat 1, a front leg unit 2 pivotally connected to a front end portion of the seat 1, a rear leg unit 3 pivotally connected to a rear end portion of the seat 1, a chair back 4 connected to a top end of the rear leg unit 3, two coupling rod units 5 that are spaced apart in a left-right direction (X), and a safety mechanism 6.

The seat 1 includes a base frame 11, and a seat cushion 12 mounted to the base frame 11. In this embodiment, the base frame 11 may be made of either plastic or metallic material, and the seat cushion 12 is made from a soft material. The base frame 11 has a rear portion formed with two grooves 111 that are spaced apart in the left-right direction (X).

The front leg unit 2 includes two front legs 21 that are spaced apart in the left-right direction (X) and that are pivotally connected to the front end portion of the seat 1, and a cross brace 22 that interconnects the front legs 21. The rear leg unit 3 includes two rear legs 31 that are spaced apart in the left-right direction (X). In this embodiment, the chair back 4 integrally extends from the top end of the rear leg unit 3.

The coupling rod units 5 interconnect the front leg unit 2 and the rear leg unit 3. Each of the coupling rod units 5 includes a first coupling rod 51 that has opposite ends pivotally and respectively connected to the seat 1 and the rear leg unit 3, a second coupling rod 52 that has opposite ends pivotally and respectively connected to the front leg unit 2 and the first coupling rod 51, and a third coupling rod 53 that has opposite ends pivotally and respectively connected to the second coupling rod 52 and the rear leg unit 3. Specifically, in this embodiment, for each of the coupling rod units 5, the opposite ends of the first coupling rod 51 are pivotally and respectively connected to the base frame 11 of the seat 1 and the corresponding one of the rear legs 31, the opposite ends of the second coupling rod 52 are pivotally and respectively connected to the cross brace 22 and the first coupling rod 51, and the opposite ends of the third coupling rod 53 are pivotally and respectively connected to the second coupling rod 52 and the corresponding one of the rear legs 31. In other embodiments, the folding chair may have only one coupling rod unit 5 instead of two.

The safety mechanism 6 is disposed in proximity to one of the coupling rod units 5, and includes a hollow blocking base 61 that is mounted to the bottom end of the base frame 11 of the seat 1 and that is in proximity to one of the grooves 111, a blocking member 62 that is mounted to the blocking base 61 and that is disposed in proximity to the first coupling rod 51 of the one of the coupling rod units 5, and a resilient member 63.

The blocking member 62 has a blocking portion 621 that extends through the blocking base 61 in the left-right direction (X), and a control portion 622 that is connected to the blocking portion 621 and that is disposed outside of the blocking case 61.

The blocking portion 621 has a first end section connected to the control portion 622, and a second end section opposite to the first end section. The second end section of the blocking portion 621 has a blocking surface 626 and a guiding surface 625 opposite to the blocking surface 626. A thickness of the second end section between the blocking surface 626 and the guiding surface 625 decreases in a direction away from the first end section of the blocking portion 621. In this embodiment, the guiding surface 625 is a curved surface.

The control portion 622 has a connecting portion 623 that is pivotally connected to the first end section of the blocking portion 621 and that abuts against the blocking base 61, and an access portion 624 that is connected transversely to the connecting portion 623 and that extends in a direction away from the blocking portion 621.

The resilient member 63 is mounted in the blocking base 61. In this embodiment, the resilient member 63 is a spring that is sleeved on the blocking portion 621 of the blocking member 62. The resilient member 63 has two opposite ends respectively in contact with and abutting against an inner surface of the blocking base 61 and the second end section of the blocking portion 621 of the blocking member 62.

Figure 2:
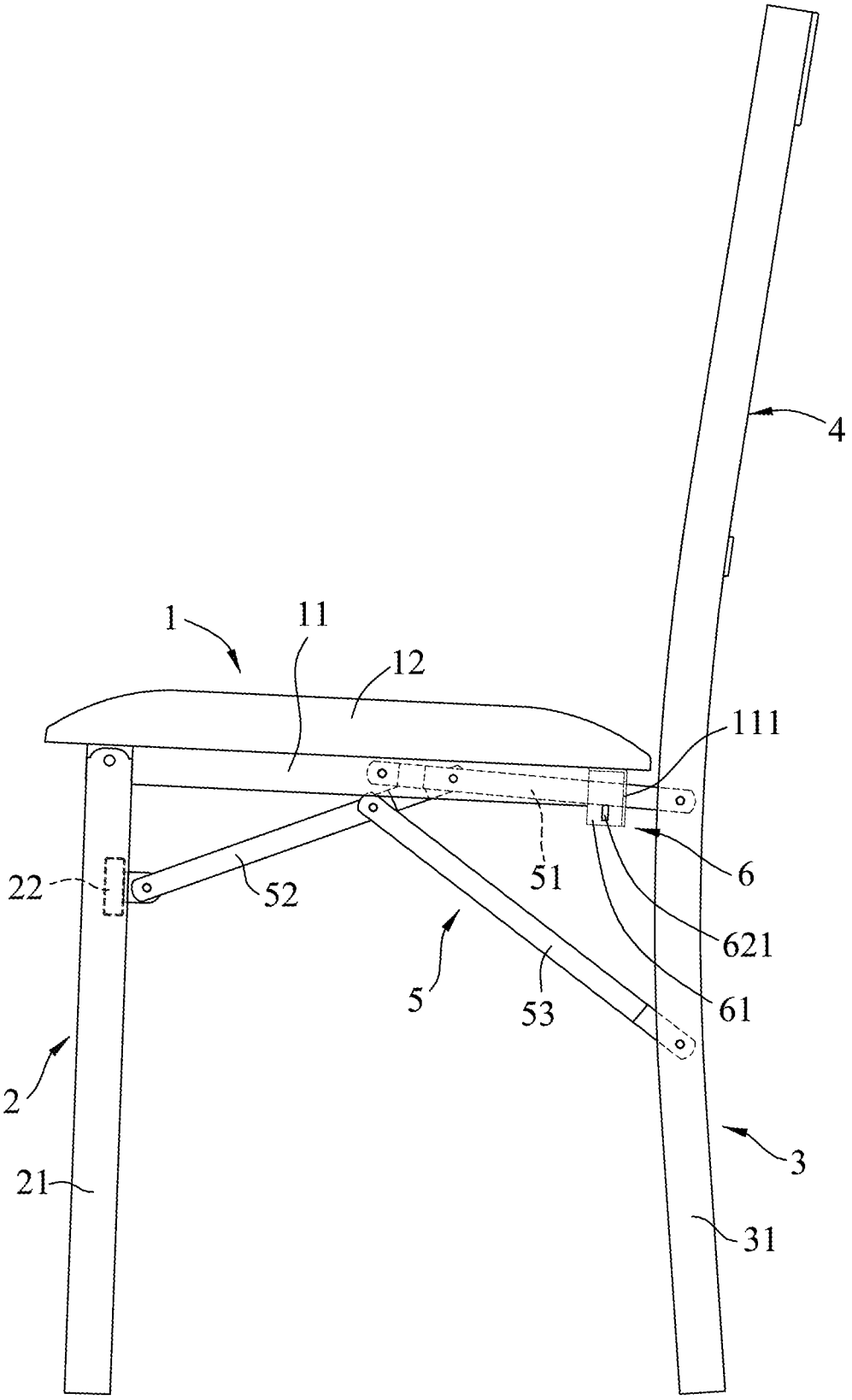
FIG. 2 is a side view of the embodiment, illustrating the embodiment in an unfolded state.
Figure 3:
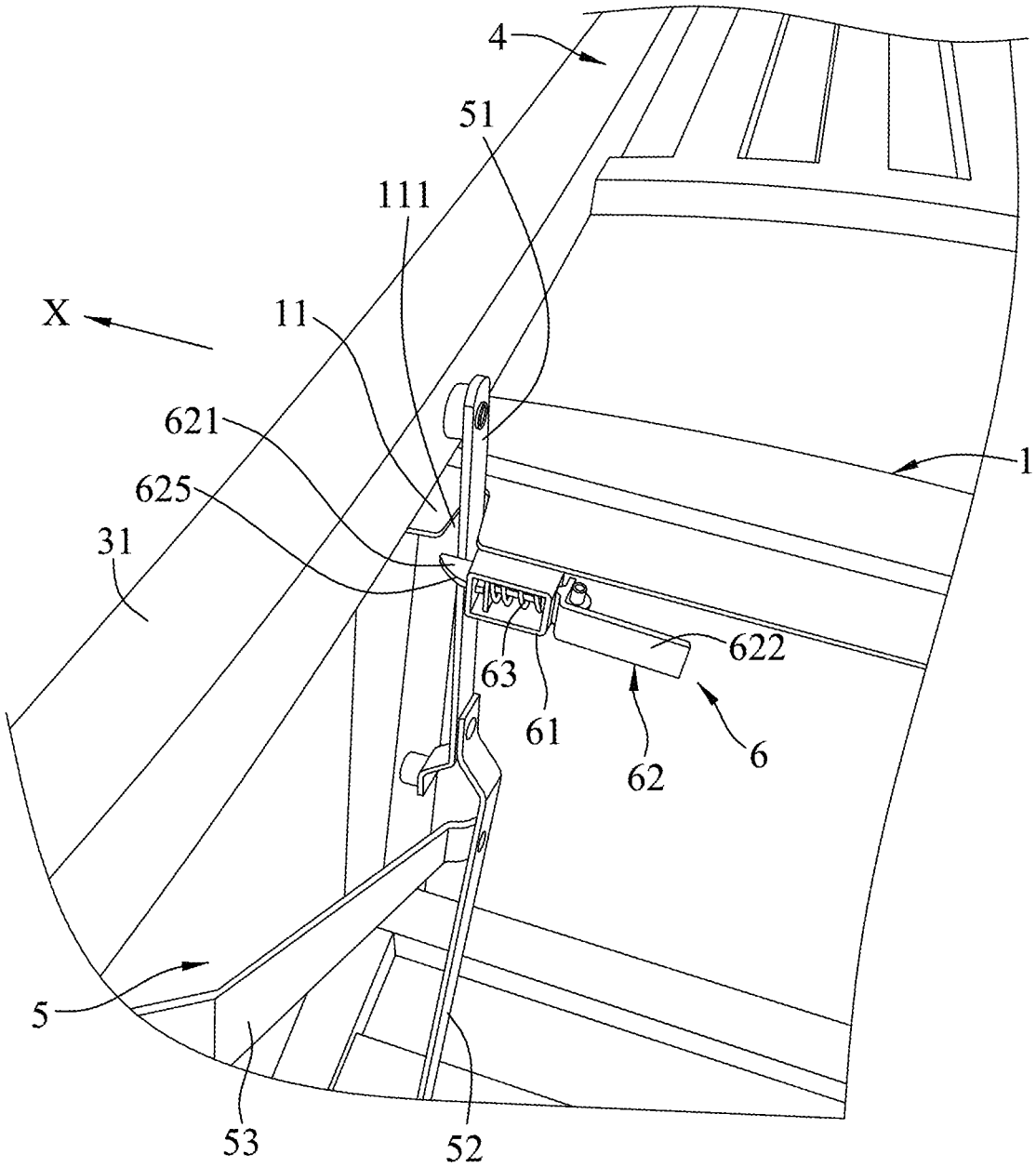
FIG. 3 is a fragmentary perspective view of the embodiment, illustrating a blocking member of a safety mechanism in a locked state.
Figure 4:
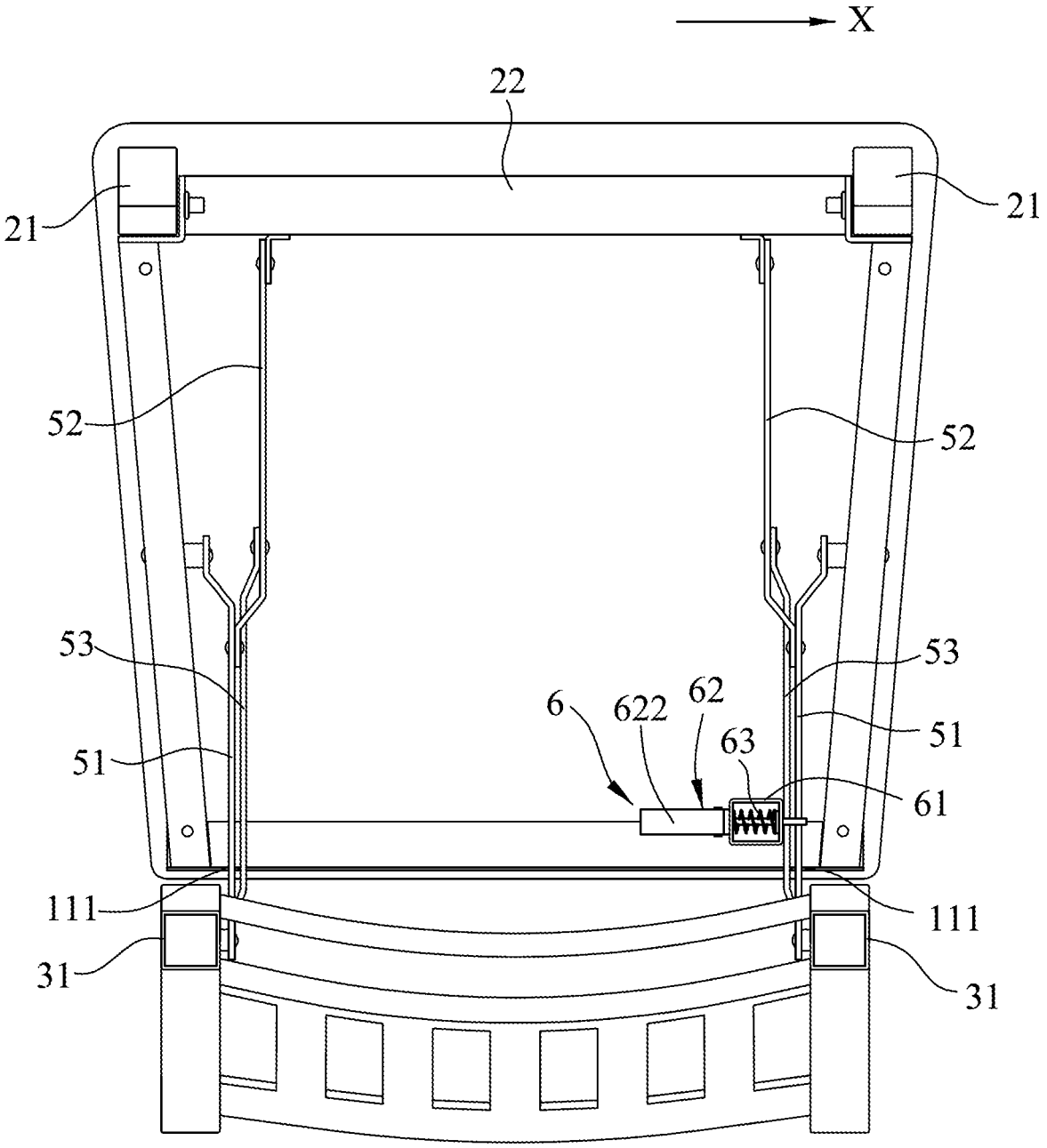
FIG. 4 is a bottom view of the embodiment.
Figure 5:
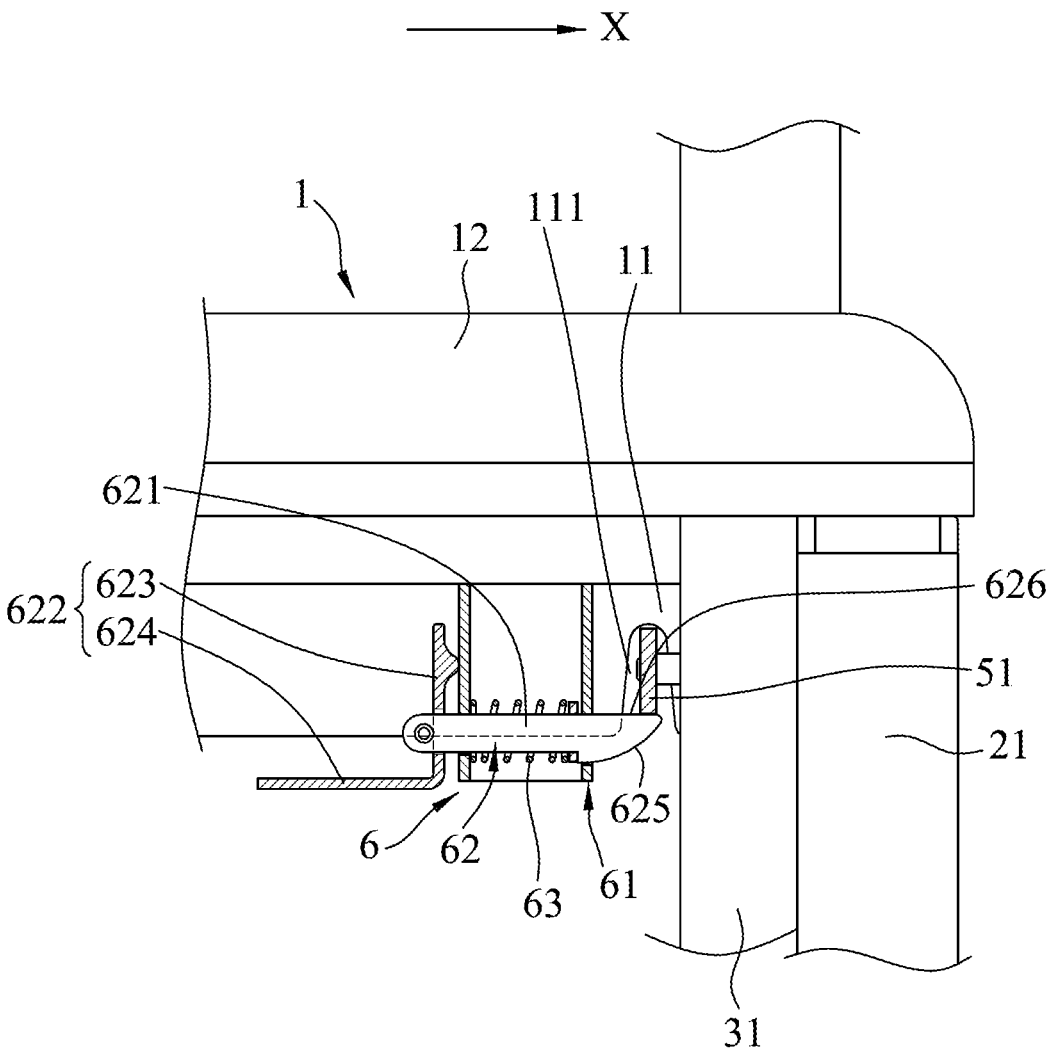
FIG. 5 is a fragmentary, partly sectional view of the embodiment, illustrating the blocking member in the locked state.

The folding chair is convertible between a folded state (FIG. 7) and an unfolded state (FIGS. 1 and 2). When the folding chair is in the unfolded state, the first coupling rod 51 of each of the coupling rod units 5 is disposed under the seat 1 and is engaged with a respective one of the grooves 111. To maintain the folding chair in the unfolded state, the blocking member 62 is switched to a locked state (see FIGS. 3 and 5), in which the blocking surface 626 of the blocking portion 621 of the blocking member 62 abuts against a bottom of the first coupling rod 51 of the one of the coupling rod units 5 for blocking the first coupling rod 51 from being disengaged from the respective one of the grooves 111.

Before the folding chair is to be folded into the folded state, a user can operate the control portion 622 of the blocking member 62 to switch the blocking member 62 from the locked state to an unlocked state (see FIG. 6) by pressing upwardly the access portion 624 of the control portion 622, such that the control portion 622 functions as a lever (since the connecting portion 623 abuts against the blocking base 61) to move the blocking portion 621 away from the first coupling rod 51 of the one of the coupling rod units 5. At this time, the bottom of the first coupling rod 51 is not obstructed by the blocking surface of the blocking portion 621, and is permitted to be downwardly pivoted relative to the seat 1 to convert the folding chair from the unfolded state to the folded state via pivotal movements of the second and third coupling rods 52, 53 of the coupling rod units 5. The resilient member 63 is disposed for pushing resiliently the blocking portion 621 of the blocking member 62 toward the locked state. Once the upward force applied to the access portion 624 is gone, the resilient member 63 automatically biases the blocking portion 621 of the blocking member 62 to the locked state.

Figure 6:
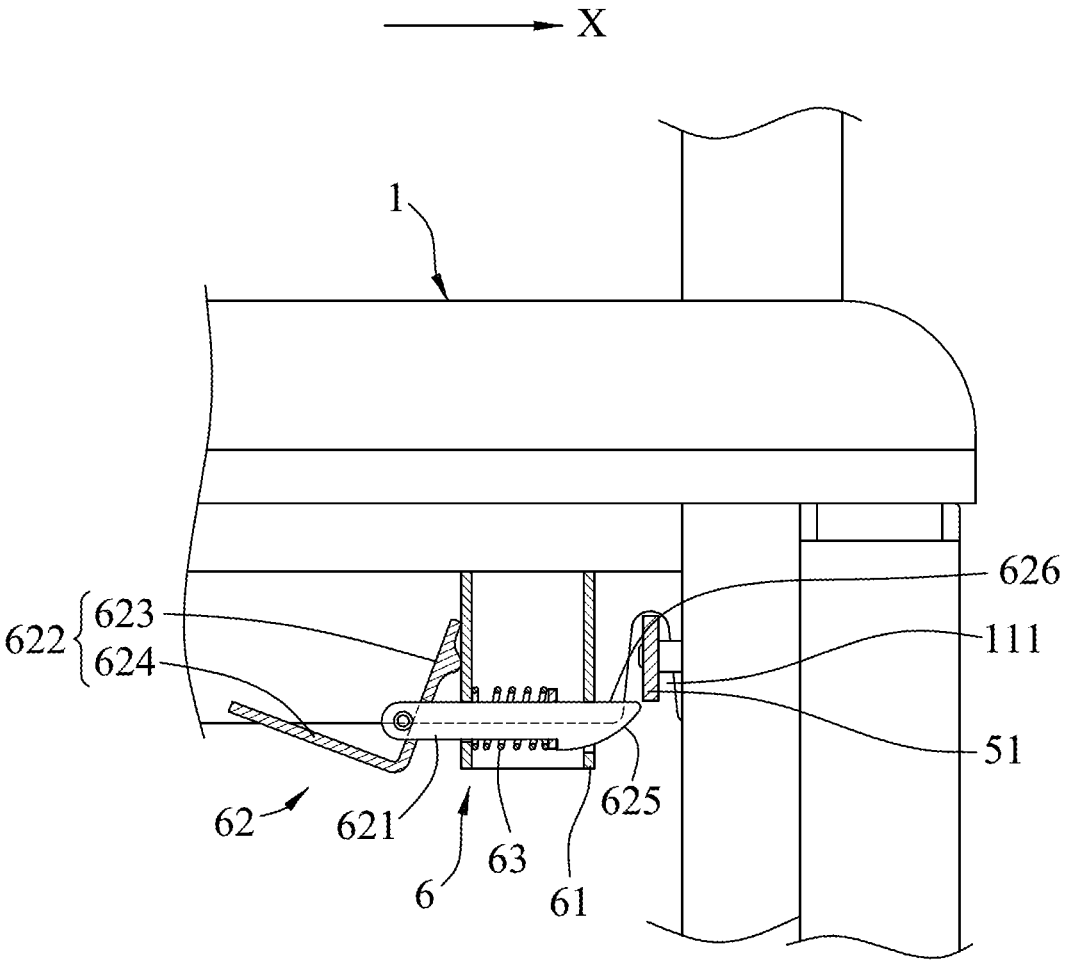
FIG. 6 is a view similar to FIG. 5, illustrating the blocking member in an unlocked state.
Figure 7:
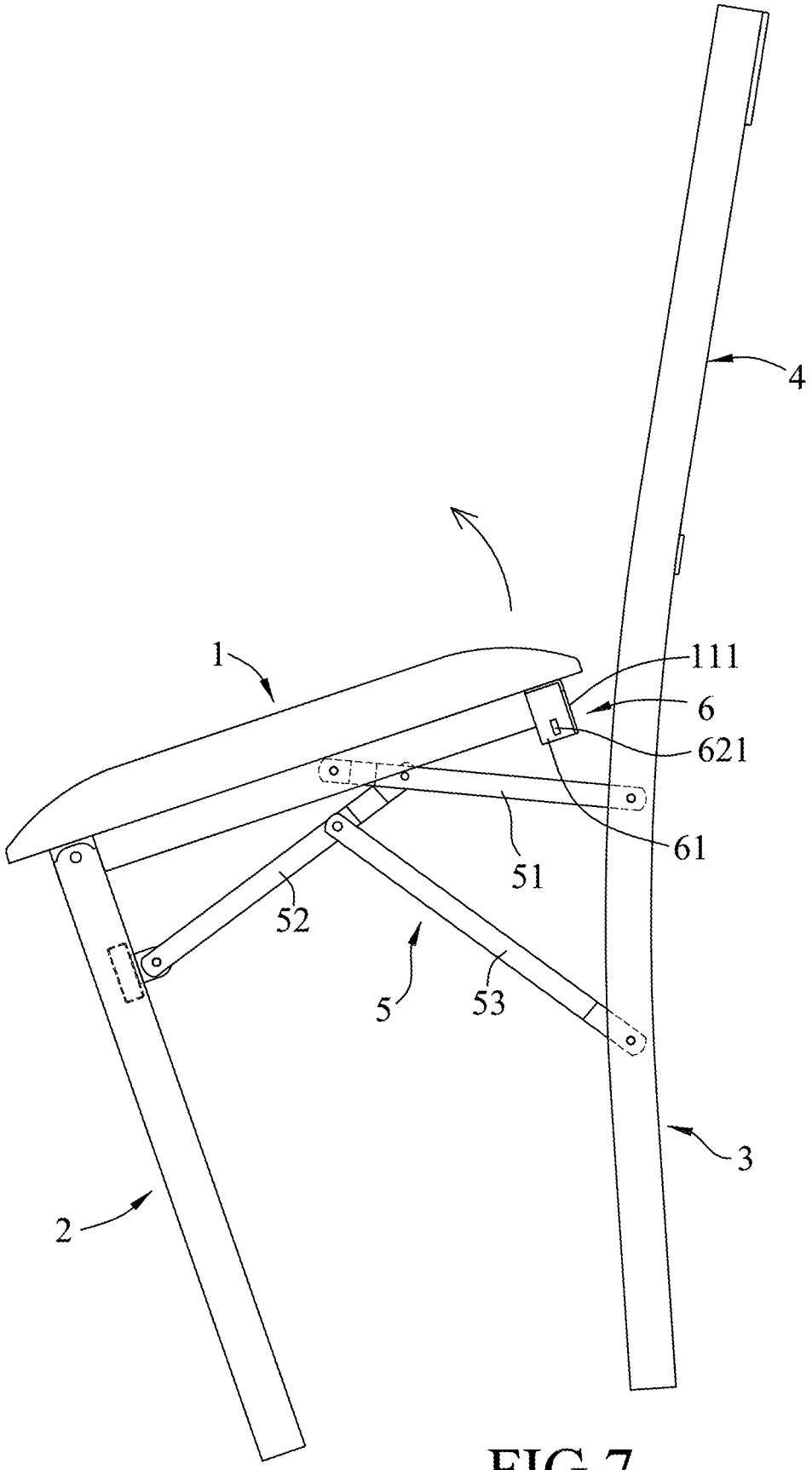
FIG. 7 is a side view of the embodiment, illustrating the folding chair being converted from the unfolded state toward a folded state.
Figure 8:
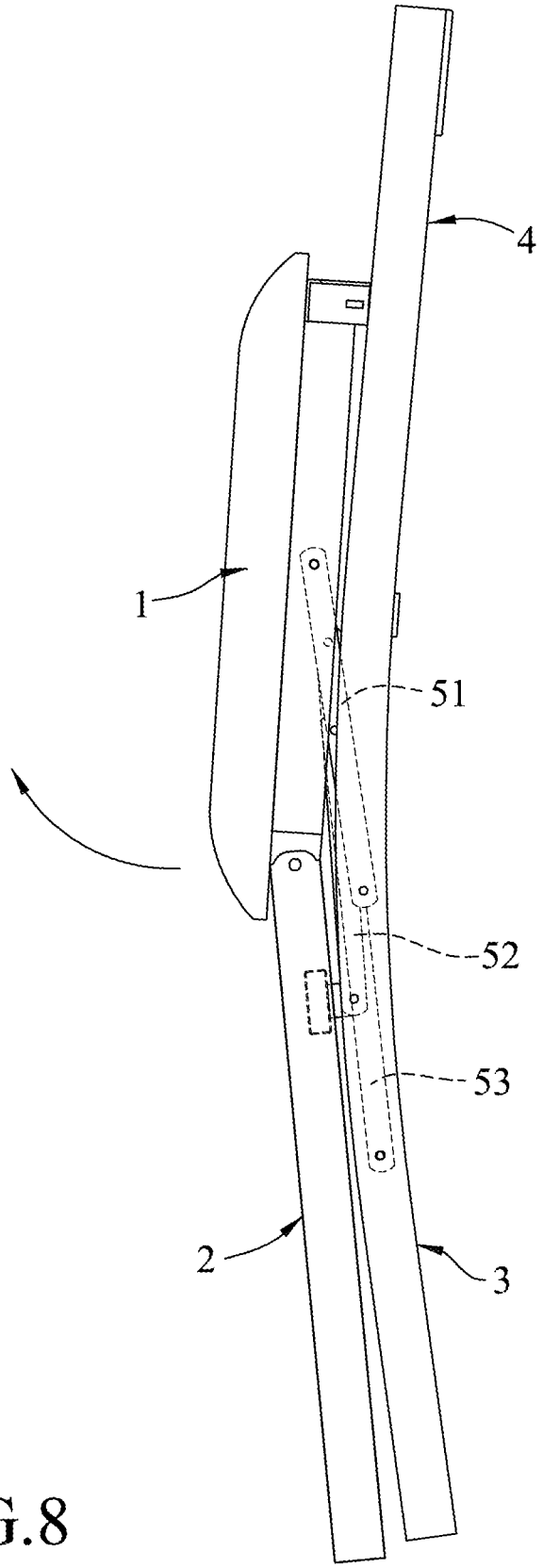
FIG. 8 is a side view of the embodiment, illustrating the folding chair in the folded state.

Referring to FIGS. 6 to 8, when the blocking member 62 is in the unlocked state, the first coupling rod 51 of each of the coupling rod units 5 is operable to move outside of the respective one of the grooves 111. Specifically, the user can pull upwardly the rear end portion of the seat 1 away from the chair back 4, such that the first coupling rod 51 of each of the coupling rod units 5 is disengaged from the respective one of the grooves 111 of the seat 1 and at a side of the blocking portion 621 which is opposite to the blocking surface 625, and such that the pivotal movement of the coupling rod unit 5 is initiated. When the folding chair reaches the folded state, the seat 1 becomes substantially vertical and the front leg unit 2 is adjacent to the rear leg unit 3 (see FIG. 7).

Referring back to FIGS. 5, 7 and 8, the user can revert the folding chair back to the unfolded state by pulling the front end portion of the seat 1 upwardly, such that the seat 1 becomes substantially horizontal and that the front leg unit 2 is moved away from the rear leg unit 3. During the reverting process, when the first coupling rod 51 of the respective one of the coupling rod units 5 moves to the blocking portion 621 of the blocking member 62, and is in contact with the guiding surface 625 of the blocking portion 621, the first coupling rod 51 would slide along the guiding surface 625 to push away the blocking portion 621 against the resilient force of the resilient member 63 to be engaged with the groove 111 of the groove 11 once again (see FIG. 4).

In summary, the folding chair can be folded via the pivotal movement of the coupling rod units 5. The implementation of the safety mechanism 6 ensures that the folding chair would remain in the unfolded state unless the blocking member 62 of the safety mechanism 6 is switched to the unlocked state, ensuring that the folding chair cannot be folded unintentionally.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A folding chair comprising:

a seat;

a front leg unit pivotally connected to a front end portion of said seat;

a rear leg unit pivotally connected to a rear end portion of said seat;

a chair back connected to a top end of said rear leg unit;

at least one coupling rod unit including a first coupling rod that has opposite ends pivotally and respectively connected to said seat and said rear leg unit, a second coupling rod that has opposite ends pivotally and respectively connected to said front leg unit and said first coupling rod, and a third coupling rod that has opposite ends pivotally and respectively connected to said second coupling rod and said rear leg unit, said folding chair being convertible between a folded state and an unfolded state, said first coupling rod being disposed under said seat when said folding chair is in the unfolded state, and being downwardly pivotable relative to said seat to convert said folding chair from the unfolded state to the folded state via pivotal movements of said second and third coupling rods; and a safety mechanism including a blocking member that is disposed in proximity to said first coupling rod of said at least one coupling rod unit;

wherein, when said folding chair is in the unfolded state, said blocking member is switchable between a locked state, in which said blocking member abuts against a bottom of said first coupling rod for blocking movement of said first coupling rod to maintain said folding chair in the unfolded state, and an unlocked state, in which said bottom of said first coupling rod is not obstructed by said blocking member, such that conversion of said folding chair to the folded stated is permitted;

wherein said blocking member of said safety mechanism has a blocking portion that abuts against said bottom of said first coupling rod when said blocking member is in the locked state, and a control portion that is connected to said blocking portion and that is operable for switching said blocking member from the locked to unlocked states:

wherein said safety mechanism further includes a hollow blocking base that is mounted to said seat, and a resilient member that is mounted in said blocking base for pushing resiliently said blocking portion of said blocking member toward the locked state;

wherein said blocking portion of said blocking member extends through said blocking base and is in contact with said resilient member; and wherein said control portion of said blocking member is disposed outside of said blocking case and has a connecting portion that is pivotally connected to said blocking portion and that abuts against said blocking base, and an access portion that is connected transversely to said connecting portion.

2. The folding chair as claimed in claim 1, wherein:

said blocking portion has a first end section connected to said control portion of said blocking member, and a second end section opposite to said first end section;

said second end section of said blocking portion of said blocking member has a blocking surface abutting against said bottom of said first coupling rod when said folding chair is in the unfolded state, and a guiding surface opposite to said blocking surface;

when said folding chair is in the folded state, said first coupling rod is at a side of said blocking portion which is opposite to said blocking surface; and a thickness of said second end section of said blocking portion between said blocking surface and said guiding surface decreases in a direction away from said first end section of said blocking portion.

3. The folding chair as claimed in claim 2, wherein said guiding surface is a curved surface.

4. The folding chair as claimed in claim 1, wherein:

said seat is formed with a groove that is engaged with said first coupling rod when said folding chair is in the unfolded state;

said first coupling rod is blocked by said blocking member from being disengaged from said groove when said blocking member is in the locked state; and said first coupling rod is permitted to move outside of said groove when said blocking member is in the unlocked state.

5. The folding chair as claimed in claim 1, wherein said at least one coupling rod unit includes two coupling rod units that are spaced apart in a left-right direction, said safety mechanism being disposed in proximity to one of said coupling rod units.

6. The folding chair as claimed in claim 5, wherein:

said front leg unit includes two front legs that are spaced apart in the left-right direction and that are pivotally connected to said front end portion of said seat, and a cross brace that interconnects said front legs;

said rear leg unit includes two rear legs that are spaced apart in the left-right direction;

for each of said coupling rod units, said opposite ends of said second coupling rod are pivotally and respectively connected to said cross brace and said first coupling rod; and for each of said coupling rod units, said opposite ends of said third coupling rod are pivotally and respectively connected to said second coupling rod and a corresponding one of said rear legs.

* * * * *